US006106113A

United States Patent [19]

Yamazaki et al.

[11] Patent Number: 6,106,113

[45] Date of Patent: Aug. 22, 2000

[54] INK JET RECORDING METHOD AND INK JET RECORDING APPARATUS

[75] Inventors: Hideo Yamazaki; Yasuhiko Kosugi, both of Nagano, Japan

[73] Assignee: Seiko Epson Corporation, Tokyo, Japan

[21] Appl. No.: 09/013,291

[22] Filed: Jan. 26, 1998

Related U.S. Application Data

[62] Division of application No. 08/285,717, Aug. 4, 1994, Pat. No. 5,760,807.

[30] Foreign Application Priority Data

Aug. 4, 1993 [JP] Japan ..... 5-194952
Aug. 4, 1993 [JP] Japan ..... 5-194954

[51] Int. Cl.[7] ..... B41J 2/01; B41J 23/00; B41J 2/15

[52] U.S. Cl. ..... 347/103; 347/37; 347/41

[58] Field of Search ..... 347/103, 41, 37, 347/16, 224, 225, 233

[56] References Cited

U.S. PATENT DOCUMENTS

| | | | |
|---|---|---|---|
| 4,232,324 | 11/1980 | Tsao | 347/41 |
| 4,401,991 | 8/1983 | Martin | 347/41 |
| 4,538,156 | 8/1985 | Durkee et al. | 347/103 |
| 4,595,948 | 6/1986 | Itoh et al. | 358/75 |
| 4,965,593 | 10/1990 | Hickman | 347/12 |
| 5,099,256 | 3/1992 | Anderson | 347/103 |
| 5,212,498 | 5/1993 | Sugimori | 346/25 |
| 5,485,183 | 1/1996 | Zandian et al. | 347/4 |

FOREIGN PATENT DOCUMENTS

| | | |
|---|---|---|
| 0076948 | 4/1983 | European Pat. Off. . |
| 0530627 | 12/1993 | European Pat. Off. . |
| 3620334 | 1/1987 | Germany . |

OTHER PUBLICATIONS

Patent Abstracts of Japan, vol. 17, No. 177 (M–1393), Apr. 6, 1993 (JP–A–43 332 665, Nov. 19, 1992).

Patent Abstracts of Japan, vol. 8, No. 37 (M–277), Feb. 17, 1984 (JP–A–58 194 541, Nov. 12, 1983).

*Primary Examiner*—N. Le
*Assistant Examiner*—Juanita Stephens
*Attorney, Agent, or Firm*—Sughrue, Mion, Zinn, Macpeak & Seas, PLLC

[57] ABSTRACT

In a transfer type ink jet recording system, a scanning is conducted on a transfer drum using a recording head to form ink dot strings. The recording head is moved in one sub-scanning direction with a fixed pitch so that ink drops are impacted to positions which are not adjacent to ink dot strings formed immediately before the current scanning step, whereby a repellent phenomenon is prevented from occurring. According to another aspect of the invention, the printing sequence is changed in accordance with the density of print data. A dot counter counts the number of printing dots of each of a plurality of writing blocks in a video memory. A controller decides the sequence of printing the printing blocks on the basis of the result, and transfers information indicative of the sequence of the printing blocks to a memory selector. In deciding the sequence, restriction is set so that adjacent blocks are not successively subjected to the printing step. The memory selector reads out printing data from a video memory on the basis of the sequence information, and transfers the data to a recording head.

11 Claims, 11 Drawing Sheets

SCANNING DIRECTION
A
SUBSCANNING DIRECTION
D
H1
H2
H3
H4
H5
H513
H514
S1
S2
S3
S4
P
Z
O
P
Q
W
1
2
50
12345678
12345678123456781234567812

INK JET RECORDING METHOD AND INK JET RECORDING APPARATUS

This is a divisional of application Ser. No. 8/285,717, filed Aug. 4, 94, now U.S. Pat. No. 5,760,807.

BACKGROUND OF THE INVENTION

1. Field of the Invention

The invention relates to a transfer type ink jet recording method and apparatus in which an ink image is formed on a transfer medium and then transferred to a recording medium to thereby obtain an ink image on the recording medium.

2. Description of the Related Art

A transfer type ink jet printer has the advantage that ink jet nozzles are free from clogging due to unintended contacts between a recording head and a recording sheet or due to paper dust. This advantage assures high reliability. Such transfer type ink jet printers are disclosed in U.S. Pat. Nos. 4,538,156 and 5,099,256.

In the disclosed apparatuses, an ink jet recording head (hereinafter, referred to as a recording head) having a plurality of nozzles is separated from a cylindrical transfer medium by a gap. When an ink image is to be formed on the transfer medium by the recording head, the recording head forms an ink image on the cylinder in accordance with an image signal in synchronization with the rotation of the cylindrical transfer medium, while the recording head moves in a direction parallel to the direction in which the nozzles are arranged. Then a recording medium is brought into contact with the transfer medium and pressed from the back against the transfer medium, whereby the ink image is transferred to the recording medium. Thereafter, the recording medium is discharged from the apparatus.

In another known method (Japanese Patent Publication (Kokai) No. HEI4-169,236), in order to dry and fix a recorded ink image to improve the printing quality, the total number of printed dots or the density of printed dots is counted, and a drying heater is controlled in accordance with the counted value.

In any of the above apparatuses, the transfer step must be conducted at a low pressure to ensure high efficiency and complete transfer of the image. Specifically, the step of transferring an ink image from a transfer medium to a recording sheet is conducted by applying a pressure, and therefore the transfer medium must be made of a material from which the ink image is easily peeled or which has a low surface energy. On the other hand, the ink image on the transfer medium is formed by dots produced by ink drops ejected from the recording head. Because of surface tension, such dots have a tendency to gather on a material having a low surface energy. Therefore, plural dots aggregate on the transfer medium to form a large dot. As a result, a dot may be formed at a position different from where the dot should be formed, or an ink image formed by an aggregation of dots may be deformed. Hereinafter, this phenomenon is referred to as the repellent phenomenon.

FIG. 1 schematically shows a typical example of the repellent phenomenon observed when an image is formed by groups of dots. In a prior art apparatus, a recording method is employed in which a recording head 101 having a plurality of nozzles 110 is moved in a subscanning direction indicated by an arrow U in the figure, so that dots are sequentially written from the initial position indicated by S1 to a position indicated by S2. According to this method, ink dot strings 103 are continuously sequentially overlapped on a transfer medium 102 starting from the side where the writing is initiated. The repellent phenomenon occurs more easily as the quantity of overlapping ink drops increases or as the ink amount per unit area increases. Moreover, the drying of the ink dot strings proceeds starting from the side where the writing is initiated. In an area 104 close to an ink dot string written in an earlier stage, therefore, the repellent phenomenon does not occur. In an area 105 where ink dot strings are written and the printing duty is high, conversely, there may arise a case where the repellent phenomenon occurs so that the area is divided into portions 106 having ink and portions 107 having no ink.

Japanese Patent Publication (Kokuku) No. HEI4-19,030 discloses a recording method in which ink drops are directly impacted to a recording medium while ink dot strings are alternately written in forward and reverse paths on every other row in a direction perpendicular to a scanning direction of a recording head. When this recording method is applied to a transfer type ink jet recording apparatus, however, the transfer medium does not absorb water contained in the ink as does a recording sheet, so that before an ink dot string written in the immediately preceding scanning step is completely dried, an adjacent ink dot string is written. Therefore, the repellent phenomenon occurs on the transfer medium in the manner described above, resulting in an image having reduced quality.

Also, in transfer type ink jet recording apparatuses having the above configurations, an ink image is formed while the cylindrical transfer medium makes plural turns. Therefore, the time required for forming a film of the ink image on the transfer medium varies so that the conditions of the film formation become uneven. This causes a transfer stain to be produced on a recording sheet, or causes the ink image on the transfer medium to remain partly untransferred, so that a high quality recording image cannot be obtained.

In the case where the film-forming conditions are corrected by controlling a heater or the like in accordance with the density of printed dots, furthermore, it is impossible to control the energy applied to each dot, and therefore the correction cannot be conducted in a perfect manner.

The invention has been conducted in view of the above-discussed problems. It is an object of the invention to provide an ink jet recording method and apparatus in which the repellent phenomenon that may produce an image of unacceptable quality is prevented from occurring on a transfer medium which conducts a low pressure transfer and has a high peeling property. Another object of this invention is to prevent variations in conditions under which a film is formed on a transfer medium from reducing the quality of a recording image formed on a recording medium.

SUMMARY OF THE INVENTION

According to a first aspect of the invention, an ink jet recording method for preventing the repellant phenomenon is provided in which an ink image writing step is conducted by selectively ejecting ink drops from a recording head, and comprises:

a. a first scanning step in which ink dot strings are formed in a main scanning direction so as not to adjoin each other in at least a subscanning direction;

b. a second scanning step in which the recording head is moved in the subscanning direction and ink drops are impacted to positions which are not adjacent to an ink dot string which is lastly formed on a transfer medium in the immediately preceding scanning step; and c. a step in which the second scanning step is repeated until a desired ink image is written.

The ink jet recording apparatus according to this aspect of the invention is one in which an ink image is formed in an image recording step on a surface of a transfer medium, and the ink image is transferred to a recording medium in a transfer step to obtain the ink image, and which comprises:

a recording head having a plurality of ink ejecting nozzles which are arranged in a line at predetermined intervals;

a transfer medium which is opposed to the recording head and separated therefrom by a gap and rotatably supported, and on which an ink image is formed by the above-described ink jet recording method;

moving means for moving the recording head by a predetermined distance in a subscanning direction for every turn of the transfer medium; and transfer means for transferring the ink image from the transfer medium to the recording medium.

According to the above method and apparatus, in the first scanning step, ink drops which are successively ejected from the recording head are impacted onto the transfer medium as ink dot strings in the main scanning direction and discontinuous in at least the subscanning direction. In the subsequent second scanning step, ink dot strings are impacted at positions which are not adjacent to the ink dot string which is the lastly formed one among the discontinuous ink dot strings impacted in the first scanning step. This produces results in which after the ink dot strings impacted in the first scanning step are sufficiently dried so that ink dots are fixed to respective predetermined positions, the ink dot strings of the second scanning step are impacted. Even when the impact of ink of the second scanning step is subsequently conducted, therefore, the repellent phenomenon does not occur.

According to a second aspect of the invention, an ink jet recording apparatus is provided with an image writing means for forming an ink image on a surface of a transfer medium, and transfer means for transferring the ink image to a recording medium, and is characterized in that the apparatus further comprises:

dot counting means for counting the number of printing dots of image data stored in an image memory; and sequence changing means for changing a sequence in which a writing is conducted on the transfer medium in accordance with the number of printing dots which is counted by the dot counting means.

According to another embodiment of the invention, the above ink jet recording apparatus is further characterized in that the sequence changing means changes the sequence in such a manner that dot strings which are adjacent to each other on the transfer medium are not continuously printed.

According to still another embodiment of the invention, the above ink jet recording apparatus is still further characterized in that, in a color image writing step using a plurality of recording heads, a dot in which two or more colors are to be mixed is not subjected to a plurality of printing steps in the same turn of a transfer medium.

According to the three proceeding configurations, the sequence of conducting a writing on the transfer medium is changed in accordance with the number of dots indicated by the printing data. Therefore, a block which has a large number of dots which requires a prolonged film formation time is subjected to an earlier writing step, and a block which has a small number of dots which requires a short film formation time is subjected to a letter writing step, whereby the conditions of forming a film in each block in the transfer step can be made uniform. Since dot strings which are adjacent to each other on the transfer medium are not continuously subjected to the printing step, dot strings of each block are prevented from contacting each other before the film formation, so that ink coagulation does not occur. Since the same dot is not subjected to printing steps of plural recording heads during one turn of the transfer medium, the dot overlap is conducted after the film formation and therefore the enlargement of the dot diameter due to the increase in the amount of ink present is prevented from occurring.

According to the invention, consequently, it is possible to configure an ink jet recording apparatus which can conduct recording with a high printing quality.

DETAILED DESCRIPTION OF THE PREFERRED EMBODIMENTS

Hereinafter, the invention will be described in detail by illustrating embodiments.

Figure 1:
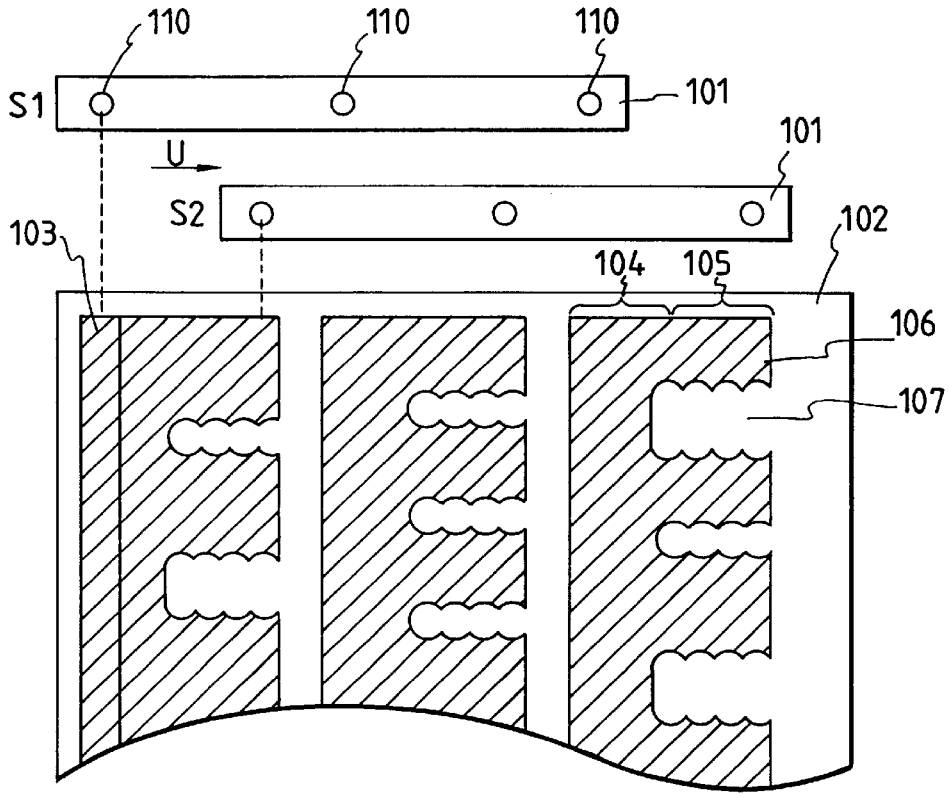
FIG. 1 is a diagram illustrating deterioration of an ink image due to the repellent phenomenon on a transfer medium.
Figure 2:
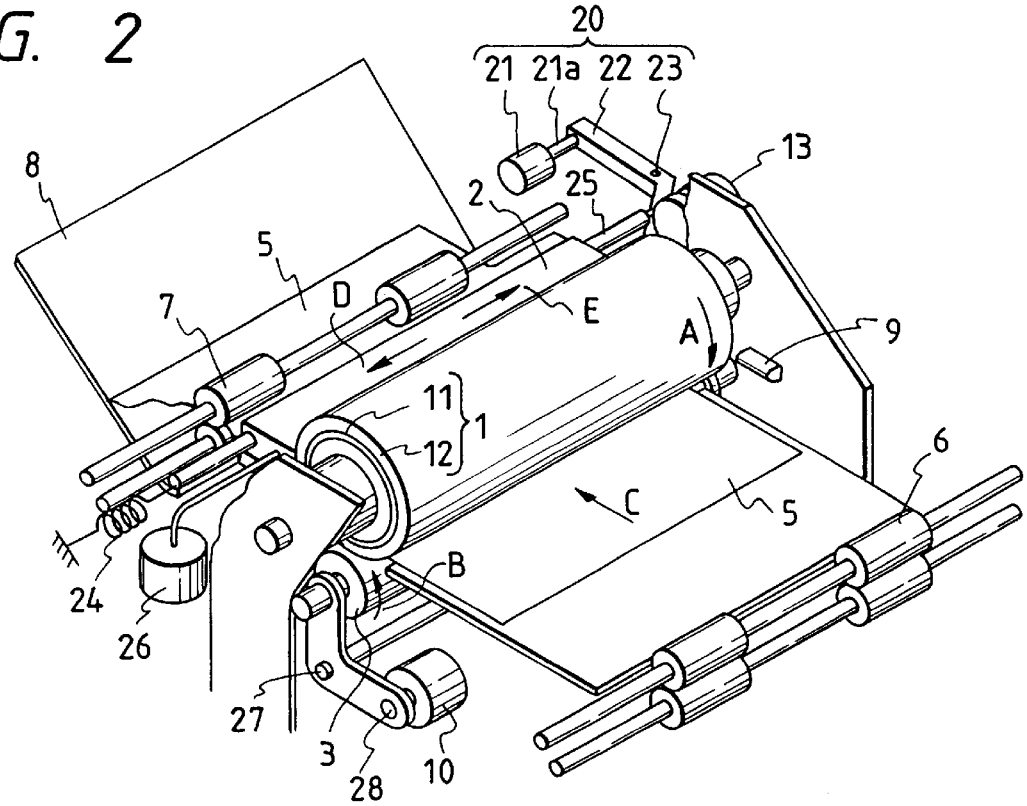
FIG. 2 is a perspective view of an ink jet printer which is a first embodiment of the invention.

FIG. 2 is a perspective view of an ink jet printer which is a first embodiment of the invention. An ink jet recording head 2 and a pressure roller 3 which functions as the transfer means are sequentially arranged around a transfer drum 1 which functions as the transfer medium. The printer further comprises a sheet supply device 6 for transporting a recording sheet 5 which functions as the recording medium to a portion where the pressure roller 3 is pressingly contacted with the transfer drum 1, a sheet discharging device 7 for discharging a recording sheet onto which an ink image has been transferred, and a sheet discharge tray 8 for holding a discharged recording sheet 5. The rotation or moving directions of the members are indicated by arrows A, B, C, D and E, respectively.

The recording head 2 is an ink jet recording head of the type which uses piezoelectric elements, and has a plurality of nozzles which are arranged at equal intervals in the axial direction of the transfer drum 1. In the embodiment, the recording head 2 has 512 nozzles arranged at 16/600-inch pitches. The recording head 2 is connected with an ink reservoir 26 so as to be supplied with ink as required. The recording head 2 is moved by moving means 20 in the direction of the arrow D, by a predetermined distance for every turn of the transfer drum 1.

The moving means 20 is composed of a lever 22 which is swingably attached so that a lever shaft 23 functions as a fulcrum, and a motor 21. One end of the lever 22 is contacted with the shaft 21*a* of the motor 21, and the other end with an end of a recording head fixing member 25. The shaft 21*a* of the motor 21 is threaded so as to be moved in the axial direction by the rotation of the motor 21. In the embodiment, the shaft 21*a* is moved by 0.5 mm for every turn of the motor 21 so that the recording head 2 is moved by 1/600 inches in the direction of the arrow D against the force exerted by a spring 24 which is attached to the other end of the fixing member 25.

The transfer drum 1 is structured by laminating an elastic layer 12 made of silicone rubber on the periphery of a metal pipe 11. Preferably, the material of the elastic layer 12 is a rubber material from which an ink image is easily peeled, and includes fluorosilicone rubber, etc., in addition to silicone rubber. The transfer drum 1 is driven by a drum driving motor 13. The rotating speed of the transfer drum 1 is controlled by a signal from a rotary encoder 9 attached to the transfer drum 1. The signal from the rotary encoder 9 is used also as the references of the printing timing of the recording head and the rotation timing of the transfer drum.

The pressure roller 3 is a roller made of a metal such as aluminum, and can be pressed against or released from the transfer drum 1 by a pressure applying device 10 through a pressure lever 28 which swings about a supporting shaft 27. When the pressure roller 3 is pressed against the transfer drum 1, the roller rotates at the same speed as the peripheral speed of the transfer drum 1 in the direction of the arrow B in the figure while the recording sheet 5 is interposed between the roller and the drum. In the embodiment, the transfer pressure is set to be about 10 kgw.

The ink contains at least water, a water soluble organic solvent, a pigment, and a colloidal dispersion resin. Specifically, the ink contains 3 wt % of carbon black as a pigment, 30 wt % of WATERSOL CD-540 (containing 40% of a resin solid component and 13% of isopropylene glycol) as a colloidal dispersion resin which is produced by DAINIPPON INK KAGAKU KOGYO and a colloidal dispersion of the modified epoxidized ester type, 5 wt % of triethanolamine as a water soluble organic solvent, and 5 wt % of polyethylene glycol as a humectant. The ink is prepared by adding purified water to these components.

Next, operation of this embodiment will be described, starting with an ink image writing step.

Figure 3:
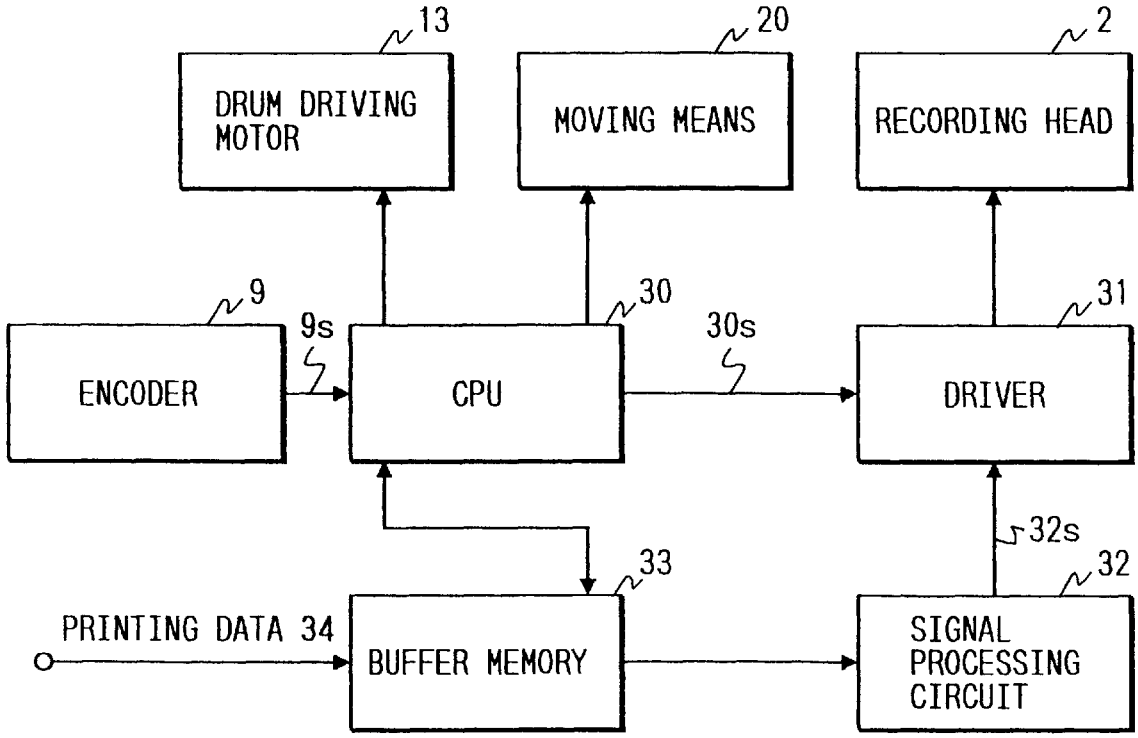
FIG. 3 is a block diagram of a control system for controlling the operation of the ink image writing step in the first embodiment of the invention.

In an ink image writing step, the pressure roller 3 is controlled so as to be separated from the surface of the transfer drum 1. The rotation direction (the direction of the arrow A in the figure) of the transfer drum 1 is defined as the main scanning direction, and the moving direction of the recording head 2 is defined as the subscanning direction. When the transfer drum 1 makes one turn in the direction of the arrow A, ink dot strings are formed in a line at positions respectively corresponding to the nozzles of the recording head 2. FIG. 3 is a block diagram of a portion for controlling the operation of the ink image writing step in the embodiment. In accordance with the rotation of the transfer drum 1, the encoder 9 generates the signal 9S at predetermined intervals. A CPU 30 receives the signal 9S and generates a timing signal 30S by which the recording head 2 is caused to eject ink drops. A driver 31 drives the recording head 2 in accordance with the timing signal 30S and a printing signal 32S from a signal processing circuit 32. In parallel with this, the dPU 30 causes the drum driving motor 13 for the transfer drum 1 to rotate, and simultaneously sends a signal to the moving means 20 for the recording head so that the recording head 2 is moved by a predetermined distance. Printing data 34 transmitted from an external device are temporarily stored in a buffer memory 33, and sorted in accordance with the moving distance of the recording head 2 in the subscanning direction.

Then the printing data 34 are transmitted to the driver 31 as the printing signal 32S through the signal processing circuit 32. These operations are repeated so that ink dot strings are formed on the transfer drum 1 as shown in FIG. 4.

Figure 4:
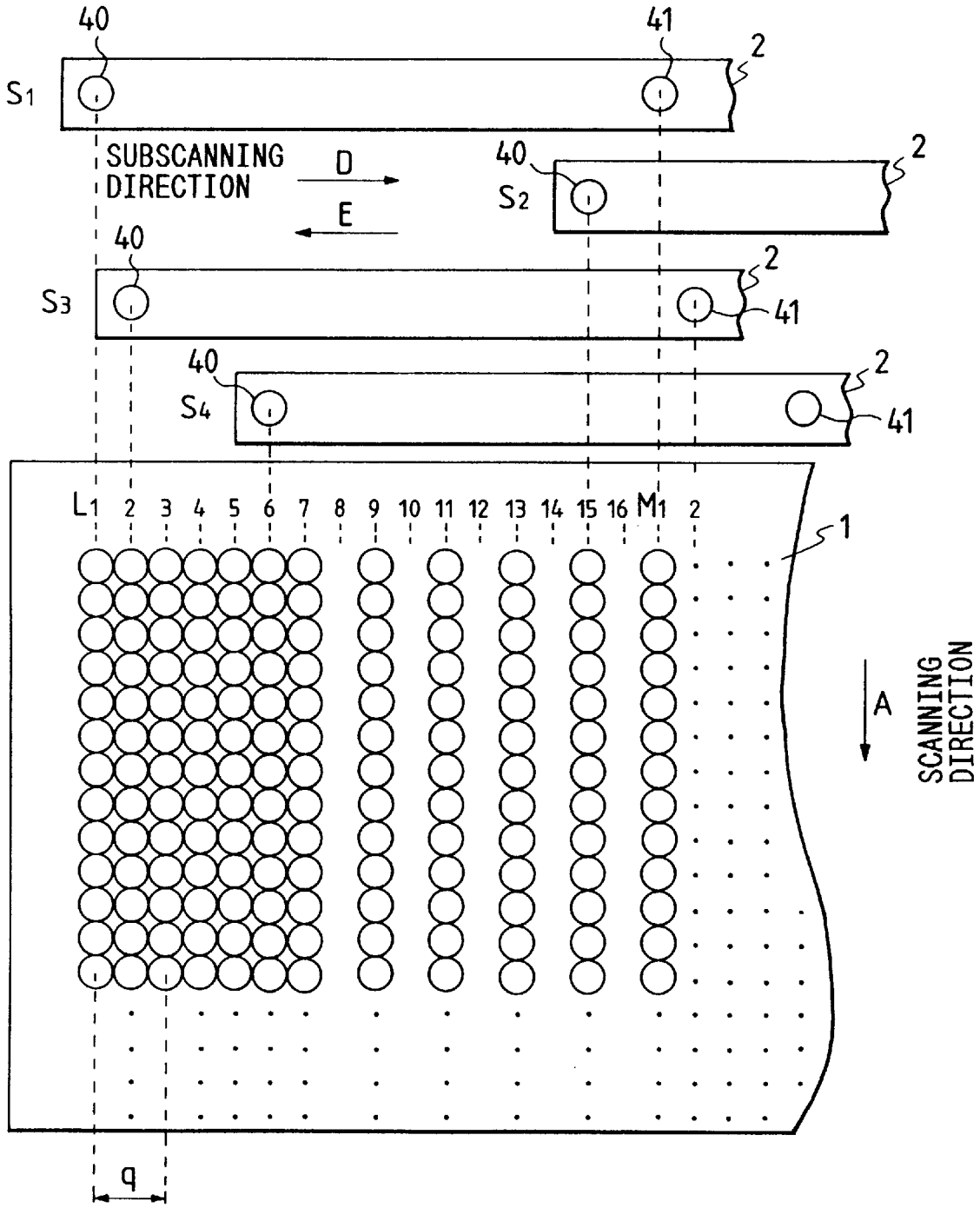
FIG. 4 is a diagram illustrating a method of conducting a scanning of a recording head which is used in the first embodiment of the invention.

FIG. 4 is a diagram illustrating a method of scanning the recording head which is used in the embodiment. For convenience of illustration, a nozzle 40 will be described representatively in a case where ink dots are impacted in the whole of the printing area. First, the recording head 2 is located at the initial position indicated by S1 in the figure, and the transfer drum 1 is rotated in the direction of the arrow A. As the first scanning step, ink dot strings L1, L3, L5 . . . L15 are formed on the transfer drum 1 in the subscanning direction at intervals of one ink dot string by ink drops which are selectively ejected from the nozzles 40. The recording head 2 is moved by the moving means 20 by q (in the embodiment, q=2/600 inches) in the subscanning direction for every turn of the transfer drum 1. In the first scanning step, the transfer drum 1 makes 8 turns so that the recording head 2 is moved to the position S2. Although the recording head 2 is moved only in the subscanning direction, for convenience sake, positions of the recording head 2 indicated by S1 to S4 are shown being shifted in the main scanning direction.

In the subsequent second scanning step, the recording head 2 is moved to the position S3, and an ink dot string L2 is formed between ink dot strings L1 and L3 which are written in the first scanning step. Similarly, ink dot strings L4, L6 . . . L16 are formed between ink dot strings which are written in the first scanning step. The ink dot string L16 which is the endmost one of the ink dot strings formed by the nozzle 40 is written so as to be adjacent to an ink dot string M1 which is formed in the first scanning step by the adjacent nozzle 41, resulting in an ink image continuous in the subscanning direction being formed on the transfer drum 1.

In the embodiment, as the second scanning step, ink dot strings are sequentially impacted to positions starting from those (the position of L2 for the nozzle 40) which are not adjacent to the ink dot strings (L15 for the nozzle 40) formed in the immediately preceding first scanning step. In other words, there is a sufficiently large time lag between the formation of ink dot strings in the first scanning step and the impact of ink drops between the ink dot strings in the second scanning step. This time lag is equal to the period from the start of the first scanning step to that of the second scanning step, and therefore sufficient for ink dot strings formed in the first scanning step to be dried. Consequently, ink dots impacted in the first scanning step are condensed before the start of the second scanning step, so as to have a high viscosity. Even when ink drops are impacted in the second scanning step to form a continuous ink image, therefore, the ink dots are fixed to respective predetermined positions and do not move. This prevents the repellent phenomenon from occurring and allows an ink image of a high quality to be formed on the transfer drum.

Next, the transfer step will be described. In the transfer step, the pressure applying device 10 is driven according to a predetermined timing so that the pressure roller 3 is controlled to be pressed against the transfer drum 1 by the pressure lever 28 which uses the supporting shaft 27 as a swing shaft. The ink image carried on the transfer drum 1 is moved as the drum is rotated and reaches the portion where the pressure roller 3 is pressed against the transfer drum 1. At this time, the recording sheet 5 is transported by the sheet supply device 6 so as to contact the transfer drum 1, and a pressure is applied by pressure roller 3 so that the ink image on the transfer drum 1 is transferred to the recording sheet 5. Since the elastic layer 12 of the transfer drum 1 has properties which allow an ink image to be easily peeled off, the ink image on the transfer drum 1 is transferred to the recording sheet 5 in a substantially perfect manner. The recording sheet 5 to which the ink image has been transferred is discharged by the sheet discharging device 7 to the sheet discharge tray 8 to be held thereon.

Figure 5:
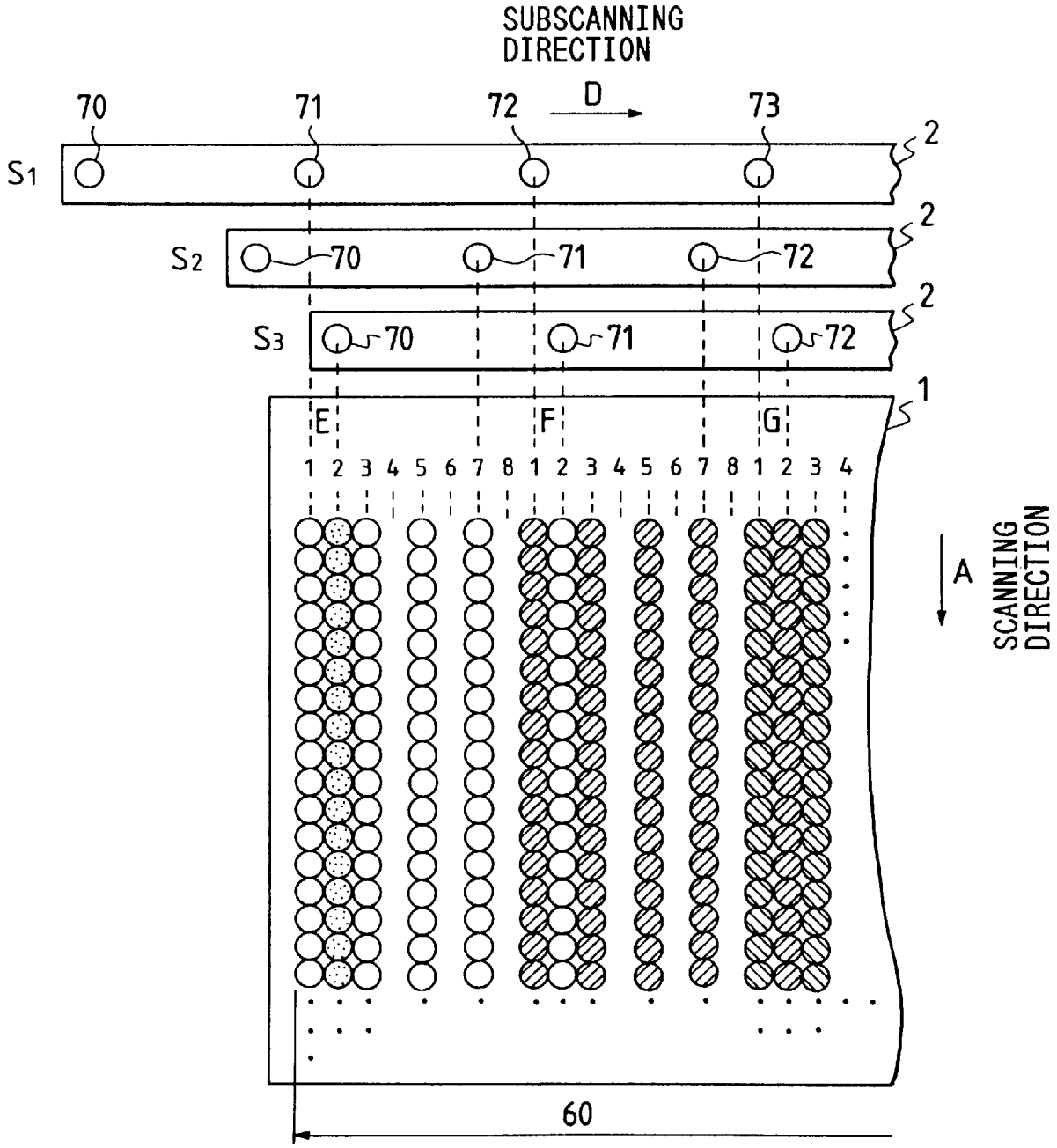
FIG. 5 is a diagram showing an ink jet recording method in a second embodiment of the invention.

Next, an ink jet recording method of a second embodiment of the invention will be described with reference to FIG. 5. This embodiment is different from the first embodiment in that a recording head is moved in one subscanning direction to form an ink image. The ink is obtained by dispersing a pigment and additives such as an emulsion and a surfactant into purified water which functions as an ink solvent. Specifically, the ink contains 1.5 wt % of carbon black as a pigment, 15 wt % of a styrene-acrylic copolymer emulsion as an emulsion, 6 wt % of diethylene glycol as a humectant, 10 to 20 wt % of sugar, 3 wt % of a surfactant, and several wt % of appropriate additives such as a preservative.

An apparatus for executing the recording method has the same configuration as that of the first embodiment, and therefore only the ink image writing step will be described. The recording head 2 has 513 nozzles 70, 71, 72, . . . which are arranged at 8/300-inch pitches in the subscanning direction indicated by the arrow D in the figure and over the full range of a printing area 60 in the subscanning direction. At least one nozzle 70 is disposed in a region outside the printing area 60. At the initial position of the recording head 2 indicated by S1, the nozzle 71 is positioned so as to coincide with an edge of the printing area 60 and the transfer drum 1 is rotated in the main scanning direction indicated by the arrow A, so that ink dot strings E1, F1, G1 . . . are written at positions respectively corresponding to the nozzles. The recording head 2 is moved in the subscanning direction D from the initial position to a position indicated by S2, with a pitch which is equal to a distance corresponding to two pixels (in the embodiment, one pixel corresponds to one ink dot and pixels are arranged in the unit of 1/300 inches) for one turn of the transfer drum 1, whereby an ink image can be formed at intervals of one ink dot string. Next, the recording head 2 is moved by a distance corresponding to 3 pixels in the subscanning direction, and ink dot strings are then written between two ink dot strings which were formed by the respective nozzles positioned at the downstream side in the subscanning direction. The position of the recording head 2 at this time is indicated by S3. When the nozzle 71 is observed, the nozzle 71 forms an ink image in the sequence of ink dot strings E1, E3, E5, and E7 at intervals of one ink dot string, and is then moved by a distance corresponding to 3 pixels in the subscanning direction, to form an ink dot string F2. Since the nozzle 70 is disposed outside the printing area 60 and in the upstream side of the subscanning direction, an ink dot string E2 is written by the nozzle 70 having an initial position which is not within the printing area.

Thereafter, the recording head 2 is moved by a distance corresponding to 2 pixels in the subscanning direction, and forms ink dot strings between ink dot strings which were previously formed, to write a continuous ink image in the printing area 60. In the embodiment, the scanning in one direction is realized by disposing at least one nozzle 70 outside the printing area 60, and changing halfway the pitch of movement of the recording head 2 in the subscanning direction. It is a matter of course that, according to this method, an ink image can be formed while the repellent phenomenon is prevented from occurring in the same manner as the first embodiment. Furthermore, it is not necessary to change the movement direction of the moving means, and therefore the recording head can be moved in the subscanning direction with an accuracy higher than that of the first embodiment so that an image of a higher quality is formed on the transfer medium.

Figure 6:
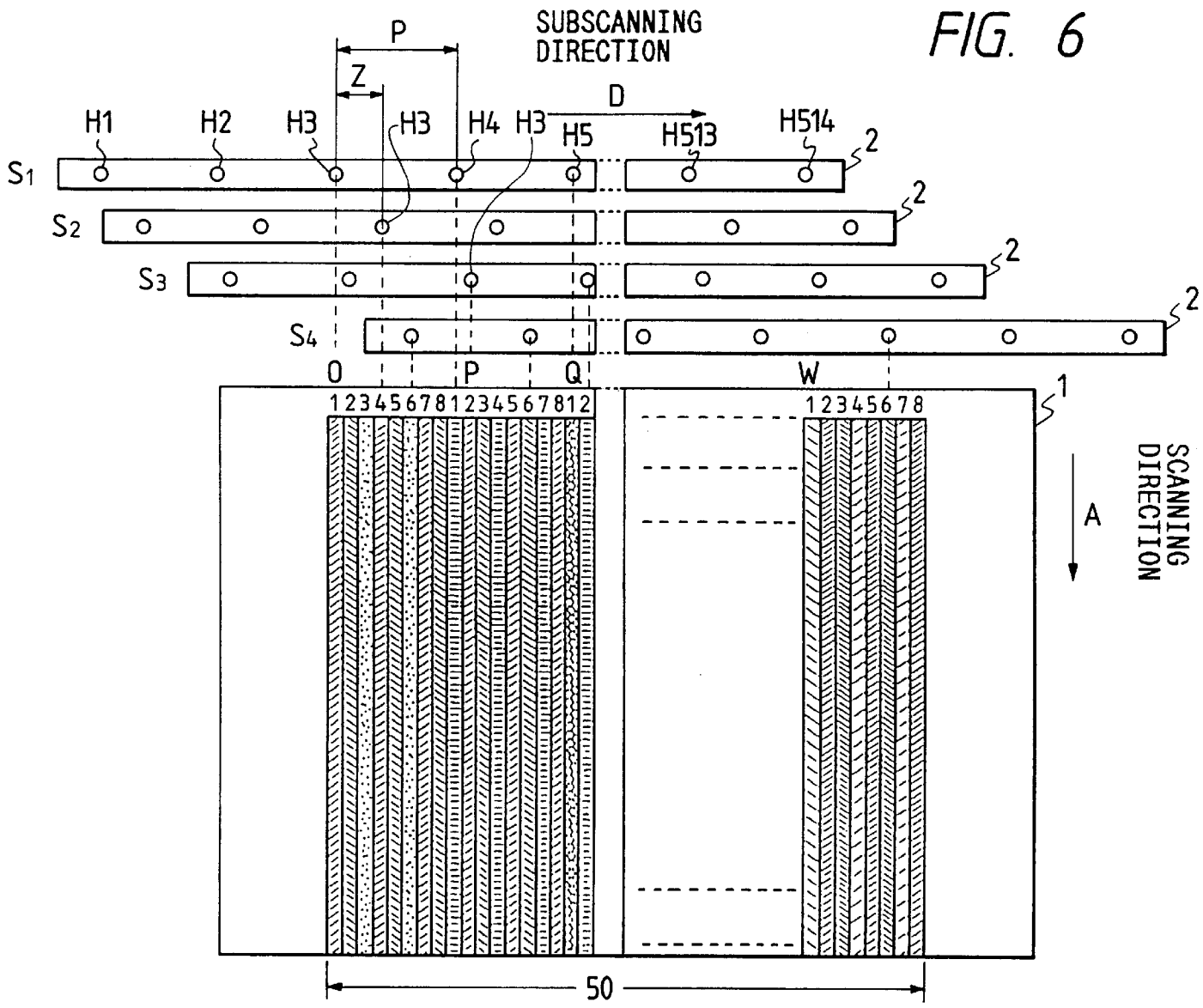
FIG. 6 is a diagram showing an ink jet recording method in a third embodiment of the invention.

A third embodiment of the invention will be described with reference to FIG. 6. FIG. 6 is a diagram illustrating the step of writing an ink image in the third embodiment of the invention. In the embodiment, a recording head is moved in one subscanning direction with a fixed pitch and ink drops are impacted to positions which art not adjacent to an ink dot string which has been formed in the immediately preceding scanning step, thereby forming a desired ink image on a transfer medium. The configuration of the apparatus is the same as that of the first embodiment, and therefore the description is concentrated on the ink image writing step.

The recording head 2 is structured so that one pixel is set to be 1/300 inches, and has 514 nozzles H1, H2, H3 . . . H514 arranged at a pitch of P pixels. When the transfer drum 1 makes one turn in the direction of the arrow A, ink dot strings are formed on the transfer drum 1 in a line at positions respectively corresponding to the nozzles of the recording head 2. The moving means 20 is controlled so that, for every turn of the transfer drum 1, the recording head 2 is moved in the subscanning direction by a distance equal to that corresponding to Z pixels. In the embodiment, P is set to be a distance equal to that corresponding to 8 pixels and Z is set to be a distance equal to that corresponding to 3 pixels.

At the initial position of the recording head 2 indicated by S1, the nozzle H3 is positioned so as to coincide with the printing start position which is the left edge of the printing area 50 of the transfer drum 1. Under this condition, ink is ejected from the nozzles H3, H4, H5 . . . to form ink dot strings O1, P1, Q1 . . . on the transfer drum 1. Then the recording head 2 is moved by a distance corresponding to Z pixels and ink drops are ejected. This position is indicated by S2. Under this condition, ink dot strings O4, P4, Q4 . . . are formed on the transfer drum 1. In this way, for every turn of the transfer drum 1, the recording head 2 is moved in the subscanning direction by a distance corresponding to 3 pixels to sequentially form ink dot strings, and the transfer drum 1 makes 8 turns so that a desired ink image is formed in the printing area 50. The position indicated by S3 indicates a position of the recording head after the drum has turned two times from the position S2.

With respect to the ink dot strings O1 to 08, the ink dot strings are arranged in the order of their formation time and are shown together with a nozzle number in parentheses by which the respective ink dot string is formed, as follows: 01(H3), 04(H3), 07(H3), 02(H2), 05(H2), 08(H2), 03(H1), and 06(H1). A nozzle(s) which is caused by the scanning of the recording head 2 to fall outside the printing area 50, for example, the nozzles H1 and H2 in the first scanning, do not eject ink and are inhibited from ejecting ink until the nozzles are moved into the printing area 50.

The relationship between the nozzle pitch P and the moving distance Z will be described. If Z/P is not an irreducible fraction, when the recording head 2 is repeatedly moved several times in the subscanning direction, the positions of the nozzles begin to coincide with those which were previously scanned, resulting in the formation of ink dot strings being conducted twice at the same positions on the transfer drum 1. When P is set to be a distance equal to that corresponding to 8 pixels and Z is set to be a distance equal to that corresponding to 2 pixels, for example, the above-mentioned coincidence is realized at a fifth turn of the transfer drum 1. In order to ensure the recording head 2 will always scan positions which are not coincident with those previously scanned, P and Z must be set so that Z/P is an irreducible fraction.

In order to form ink dot strings at positions which are not adjacent to ink dot strings that are formed in the immediately preceding scanning step, the relationship of $2 \leqq Z \leqq P-2$ must be satisfied. In other words, when Z=1 or Z=P−1, ink dot strings are sequentially written so as to be continuous in the subscanning direction. This causes ink dot strings to be formed adjacent to ink drops impacted in the immediately preceding scanning step before the ink drops are sufficiently dried, resulting in occurrence of the repellent phenomenon. In order to prevent this phenomenon from occurring, Z and P are required to be set so as to satisfy the relationship of $2 \leqq Z \leqq P-2$.

Next the position of the nozzle which is at the edge of the printing area 50 will be described.

In order that ink dots are written by conducting the scanning of the recording head 2 with a fixed pitch in one direction without leaving space between them in an edge region of the printing area 50 indicated by 01 to 08, at least Z−1 nozzle(s) must be disposed outside the region which is located in the upstream side of the subscanning direction and outside the printing area. Since the recording head 2 is moved with a pitch of Z pixels, this results in regions which are continuous and constitute a part of the printing area 50 being formed by means of at least Z nozzles. In other words, the subscanning of the recording head must be commenced when at least the Zth nozzle counted from the upstream side of the subscanning direction is made coincident with an edge of the printing area.

In summary, when Z and P are set so that Z/P is an irreducible fraction and the relationship of $2 \leqq Z \leqq P-2$ is satisfied, and the Zth nozzle counted from the upstream side of the subscanning direction is made coincident with an edge of the printing area, the movement of the recording head in one direction with a fixed pitch allows ink drops to be impacted to positions which are not adjacent to ink dot strings of the immediately preceding scanning step. Therefore, the repellent phenomenon can be prevented from occurring so that an image of a higher quality is formed on the transfer medium. According to the embodiment, the recording head can be moved in one direction with a fixed pitch, and therefore factors such as a back lash which may cause the moving means to fluctuate can be eliminated so that the movement accuracy is further enhanced, thereby realizing a higher image quality. Since regions which are continuous and constitute a part of the printing area are alternately formed by means of at least Z nozzles, the further effect of lowering deterioration of image quality due to variations between nozzles, such as those in weight and speed of ink drops, is attained. The transfer step is conducted in the same manner as that of the first embodiment, and therefore its description is omitted.

Figure 7:
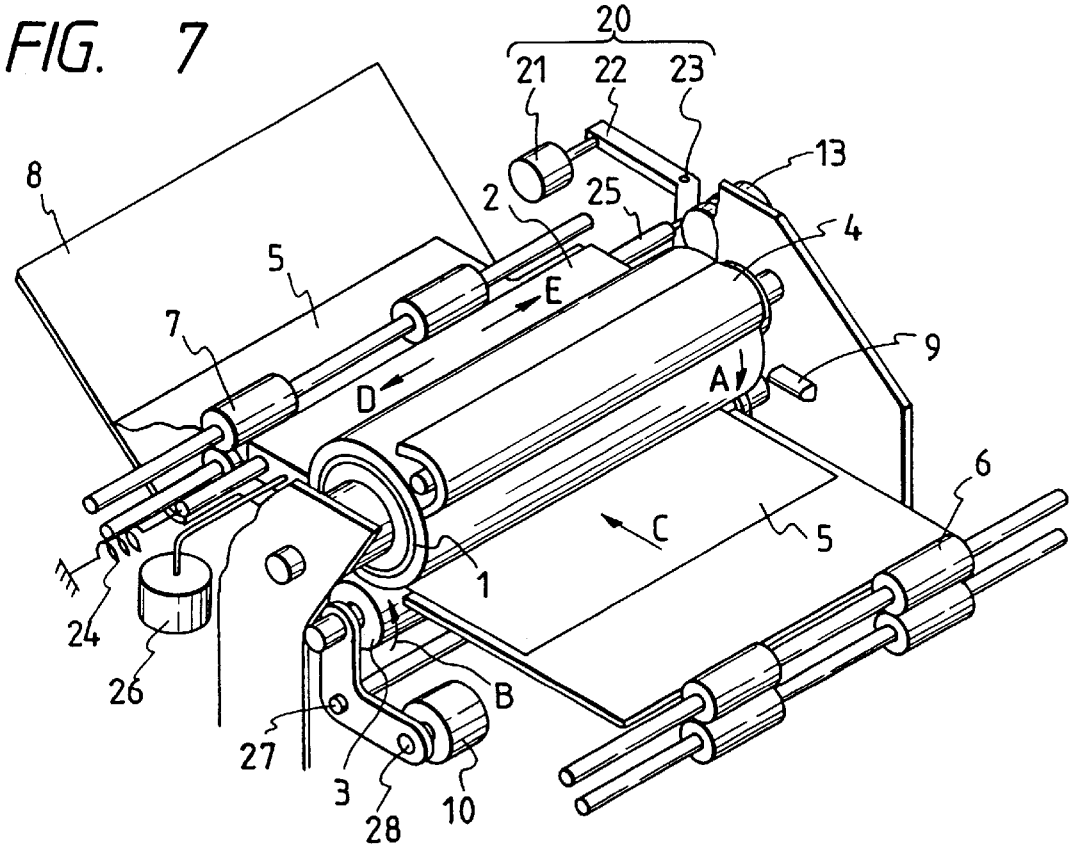
FIG. 7 is a perspective view of a transfer type ink jet printer which is a fourth embodiment of the invention.

Next, as a fourth embodiment, FIG. 7 shows a transfer type ink jet printer which can form an ink image while more effectively preventing the repellent phenomenon from occurring. The embodiment is different from the above-described embodiments in that heating means 4 incorporating a heater lamp is disposed in the periphery of the transfer drum 1 so that the drying of an ink image formed on the transfer drum 1 is accelerated. In advance of the ink image writing step, the surface of the transfer drum 1 is controlled by the heating means 4 and temperature detecting means (not shown) so as to be within a temperature range in which some content of water contained in an ink image can be evaporated and the ink image can be maintained in an appropriately dry state. In the embodiment, the surface is controlled so as to be 55±5° C.

In the ink image writing step, as illustrated in the first and second embodiments, ink dot strings are formed in the main scanning direction without adjoining each other at least in the subscanning direction. Under this condition, the surface of the transfer drum 1 is already heated. Therefore, the drying of impacted ink drops is accelerated as the transfer drum 1 rotates so that ink dots are easily fixed to predetermined positions. Even when a continuous ink image is formed by impacting ink drops in the subsequent second scanning step, consequently, the repellent phenomenon is prevented from occurring so that an ink image of a high quality is easily formed. Accordingly, the acceleration of the drying of ink drops enhances the recording speed, whereby an ink image of a high quality can be formed rapidly on a transfer medium without causing the repellent phenomenon. The transfer step is conducted in the same manner as that of the first embodiment, and therefore its description is omitted.

Figure 8:
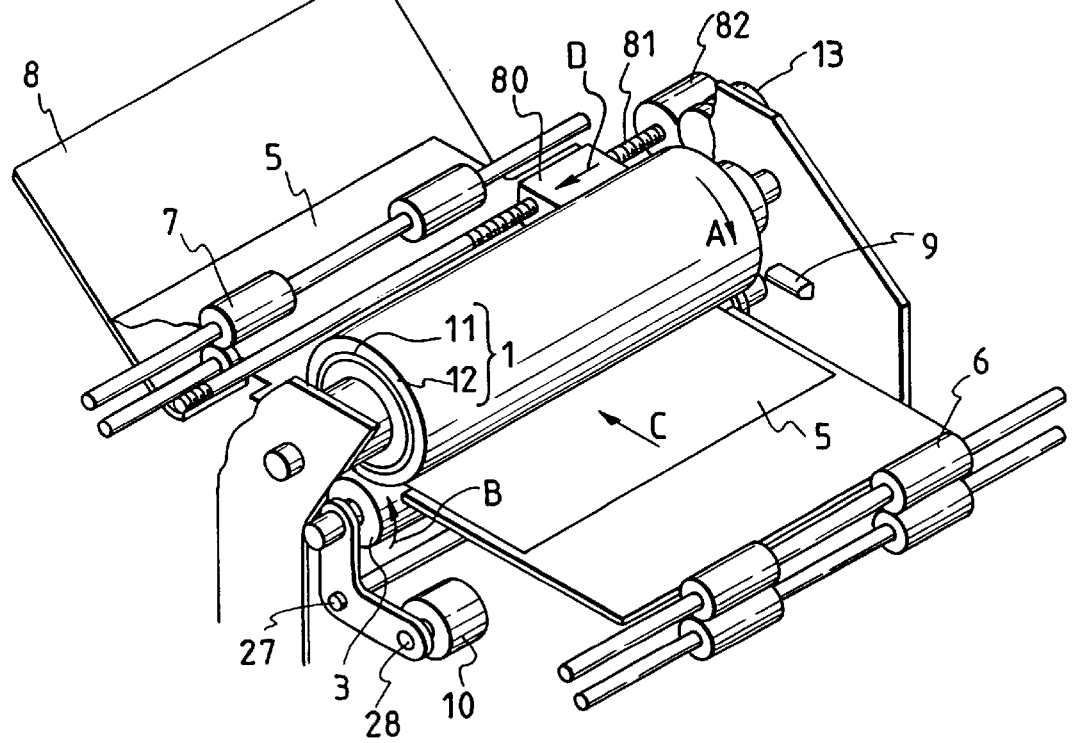
FIG. 8 is a perspective view of a transfer type ink jet printer which is a fifth embodiment of the invention.
Figure 9:
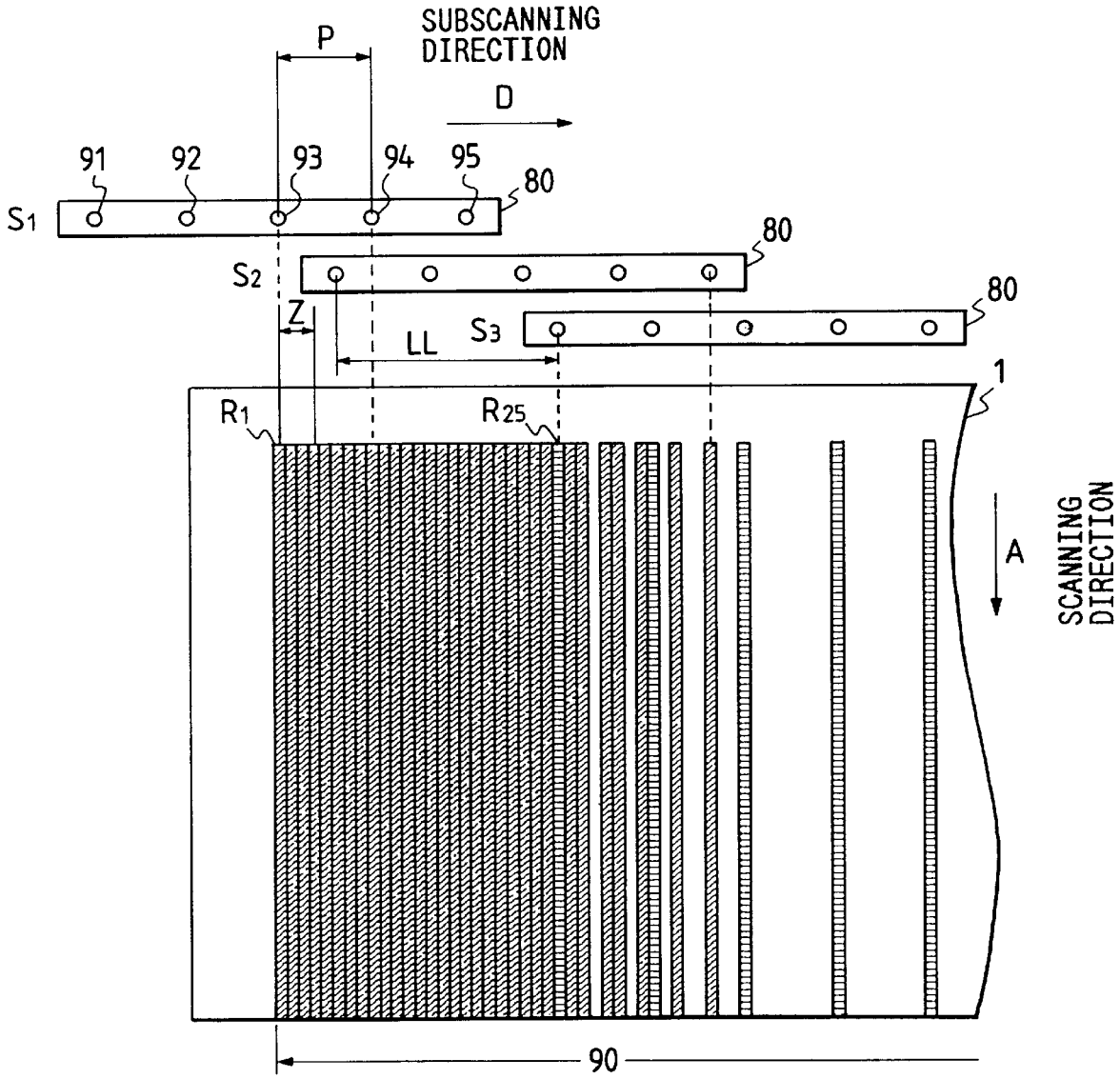
FIG. 9 is a diagram showing an ink jet recording method in the fifth embodiment of the invention.
Figure 10:
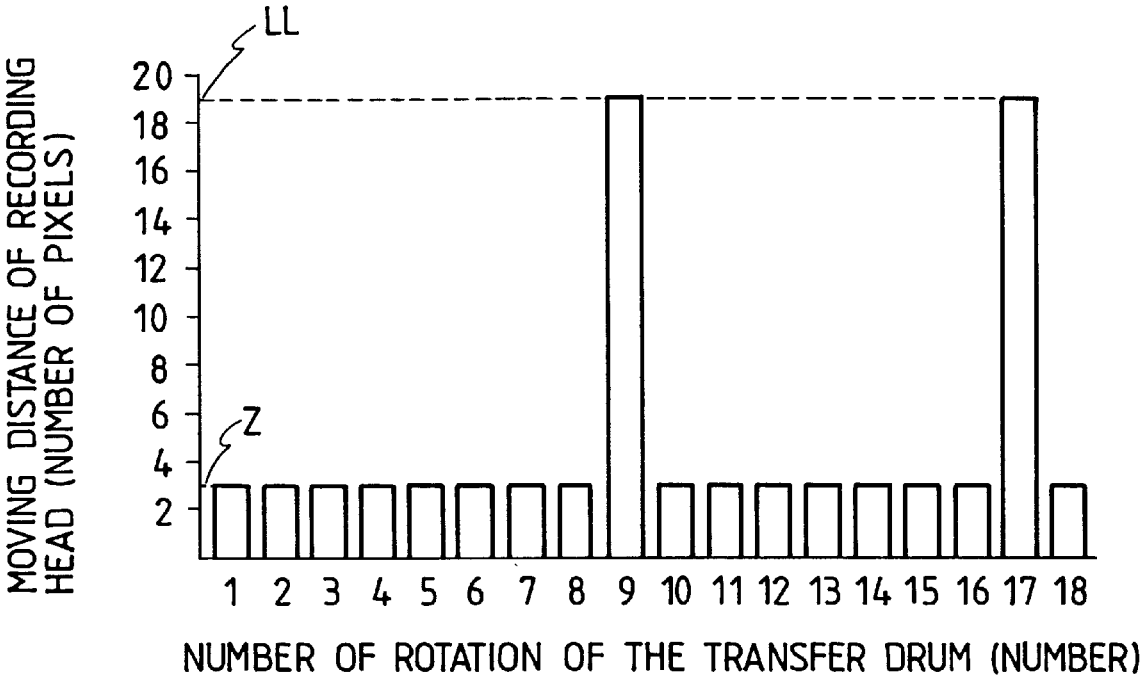
FIG. 10 is diagram showing the relationship between the rotation of a transfer drum and the moving distance of a recording head in the fifth embodiment of the invention.

Next, a fifth embodiment of the invention will be described with reference to FIGS. 8 to 10. The embodiment is configured so that a recording area is scanned plural times by a recording head shorter than the recording area while ink drops are impacted to positions which are not adjacent to ink dot strings of the immediately preceding scanning step, thereby forming a desired ink image. FIG. 8 is a perspective view of an ink jet printer and illustrates the embodiment. A recording head 80 and an ink tank which is integrated with the head are held by a threaded carriage shaft 81. The carriage shaft 81 is rotated by a motor 82 which functions as the moving means, so as to move the recording head 80 by a predetermined distance in the subscanning direction indicated by an arrow D. The other components of the embodiment are configured in the same manner as those of the first embodiment, and therefore their description is omitted.

The ink image writing step will be described. The recording head 80 has N nozzles which are arranged in the subscanning direction at a pitch that is equal to a distance corresponding to P pixels. In the embodiment, five nozzles 91 to 95 are arranged in the subscanning direction with one pixel set to be 1/300 inches and at a pitch that is equal to a distance corresponding to 8 pixels. The moving distance Z of the recording head 80 in the subscanning direction is set to be a distance corresponding to 3 pixels per one turn of the transfer drum 1. During the period in which the transfer drum 1 makes P turns (1st to 8th turns), the recording head 80 is moved from the initial position S1 to a position indicated by S2 or by a distance corresponding to 3 pixels for every turn of the transfer drum 1. When the Zth nozzle (i.e., the nozzle 93) of the recording head 80 counted from the upstream side of the subscanning direction is made coincident with an edge of a printing area 90 of the transfer drum 1, the ink image writing step is commenced so that an ink image is formed starting from an ink dot string R1 and at a pitch corresponding to 2 ink dot strings. Then the recording head 80 is moved to a position indicated by S3, or, when the nozzle 91 is observed, the nozzle 91 is moved to a position of an ink dot string R25. When the moving distance from S2 is represented by LL, the position indicated by S3 can be expressed by the following expression in terms of the nozzle number N of the recording head, the nozzle pitch P, and the moving distance Z by which the recording head is moved per one turn of the transfer drum in the subscanning direction.

$$LL=(N-Z)\times P+Z$$

In the embodiment, since N=5, Z=3, and P =8, LL is equal to 19 (LL=19). This value defines the moving distance of the recording head 80 which allows the nozzle 91 to be made coincident at the 9th turn of the transfer drum 1 with a position in a gap formed by scannings of the 1st to 8th turns of the transfer drum 1, and allows a continuous ink image to be formed in the printing area 90 without producing a double writing or a region where the writing is not conducted. FIG. 10 shows the relationship between the rotation of the transfer drum 1 and the moving distance of the recording head 80 in the subscanning direction. In the embodiment, a desired ink image is formed in the printing area 90 by repeating movements in which the moving distance is Z in 1st to Pth turns, LL in a (P+1)th turn, Z in (P+2)th to (2×P)th turns, LL in a {(2×P)+1}th turn, . . .

During the 1st to Pth turns of the transfer drum 1, the scanning is conducted with a fixed pitch in one subscanning direction. In order that ink drops are impacted to positions which are not adjacent to ink dot strings formed in the immediately preceding scanning step, as described in conjunction with the third embodiment, Z and P must be set so that Z/P is an irreducible fraction and the relationship of $2<Z<P-2$ is satisfied. However, this relationship is applied to the case of $Z/P<1$. Generally, Z and P can be set so that Z/P is an irreducible fraction and a relationship of $P\times(M-1)+2<Z<P\times(M-1)+P-2$ is satisfied when a minimum natural number M satisfying $(Z/P)<M$ is defined.

In the case where N is equal to Z (N=Z), LL becomes equal to Z (LL=Z), and all the moving distances of the recording head in the subscanning direction for every turn of the transfer drum are equal to each other. Therefore, the rotation of the motor 82 can be constant so that a scanning of high accuracy is realized, thereby enabling an ink image free from the repellent phenomenon and high in quality to be formed on the transfer medium. The transfer step is conducted in the same manner as that of the first embodiment, and therefore its description is omitted.

According to the embodiment, an ink image which is free from the repellent phenomenon can be formed by using a recording head shorter than the recording area of the transfer medium in the subscanning direction.

According to the above embodiments, ink drops are impacted onto a transfer medium which can conduct a low pressure transfer and has a high peeling property, in a discontinuous manner at least in the subscanning direction and as ink dot strings in the main scanning direction, and thereafter ink drops are impacted to positions which are not adjacent to ink dot strings formed immediately before the current scanning step. Therefore, the invention can attain an effect that the repellent phenomenon which may produce an unacceptably poor image quality is prevented from occurring so that an image of a high quality can be obtained on the transfer medium and therefore an image of a high quality can be obtained on the recording medium.

Figure 11:
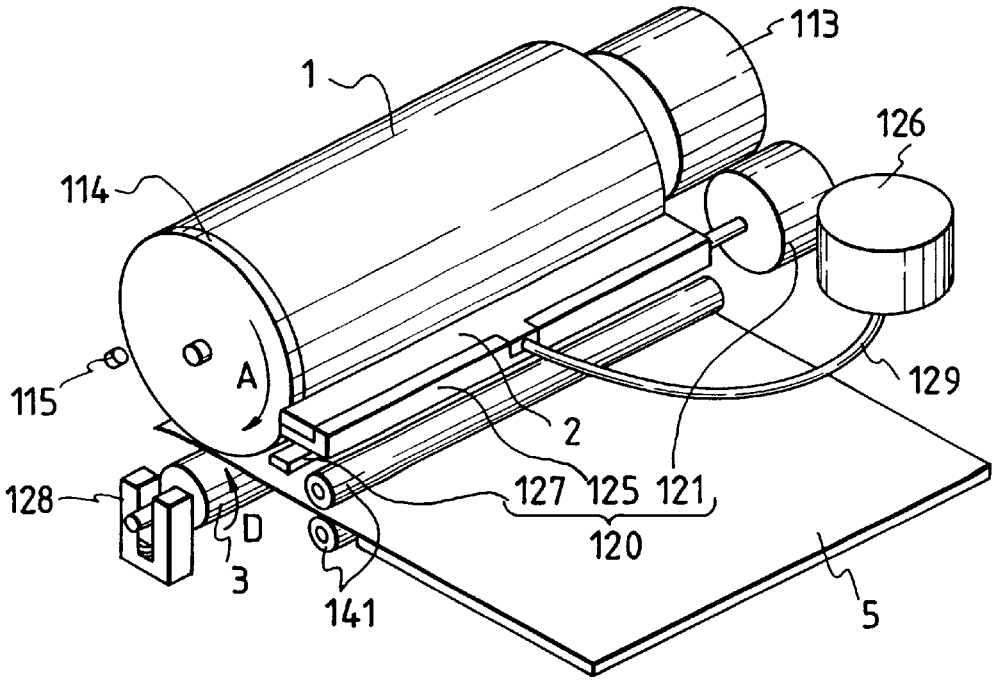
FIG. 11 is a perspective view of an ink jet recording apparatus of a sixth embodiment of the invention.

FIG. 11 is a perspective view of an ink jet printer which is a sixth embodiment of the invention. An ink jet recording head 2, and a pressure roller 3 which functions as the transfer means are sequentially arranged around a transfer drum 1 which functions as the transfer medium.

The recording head 2 is an ink jet recording head of the type which uses piezoelectric elements, and is supplied with ink from an ink reservoir 126 through an ink supply pipe 129. The recording head 2 has a plurality of nozzles which are arranged at equal intervals in the axial direction of the transfer drum 1. In the embodiment, the recording head 2 has 512 nozzles arranged at 16/600-inch pitches.

A head moving device 120 comprises a driving motor 121, a recording head holding member 125, and a movement guide 127. The recording head 2 fixed onto the recording head holding member 125 is moved by the driving motor 121 along the movement guide 127 in the axial direction of the transfer drum 1, by an arbitrary distance which is in units of 1/600 inches, with 15/600 inches as the maximum for each turn of the transfer drum 1.

The transfer drum 1 is structured by laminating an elastic layer made of silicone rubber on the periphery of a metal pipe, and has a circumference of 10 inches. The transfer drum 1 is rotated by a drum driving motor 113. A sensor 115 detects a timing mark 114 attached on the transfer drum 1 and outputs a signal indicative of the rotating speed of the transfer drum 1. Specifically, the sensor 115 generates as the output signal one pulse per 1/600 inches or 6,000 pulses for every turn of the transfer drum 1. Among these pulses, 4,864 pulses are used for determining the printing timing of the recording head.

The pressure roller 3 is a roller made of a metal such as aluminum, and is pressed against or released from the transfer drum 1 by a transfer pressure applying device 128. When the pressure roller 3 is pressed against the transfer drum 1, the roller rotates at the same speed as the peripheral speed of the transfer drum 1 in the direction of an arrow B in the figure while a recording sheet 5 is interposed between the roller and the drum. In the embodiment, the transfer pressure is set to be in the range of 10 to 50 kgw.

Next, the operation will be described. The image formation step consists of two steps, an image writing step of forming an ink image on the transfer drum 1, and a transfer step of transferring the ink image formed on the transfer drum to a recording sheet.

Figure 12:
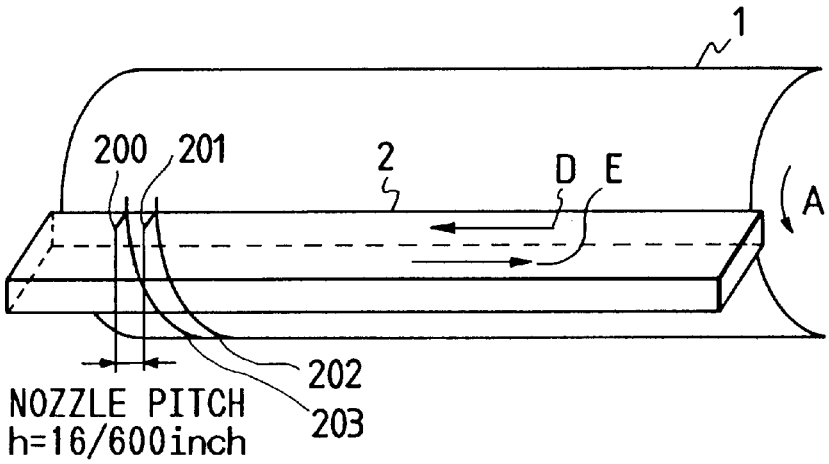
FIG. 12 is a perspective view showing the operation of moving a recording head of the ink jet recording apparatus of the sixth embodiment of the invention.
Figure 13:
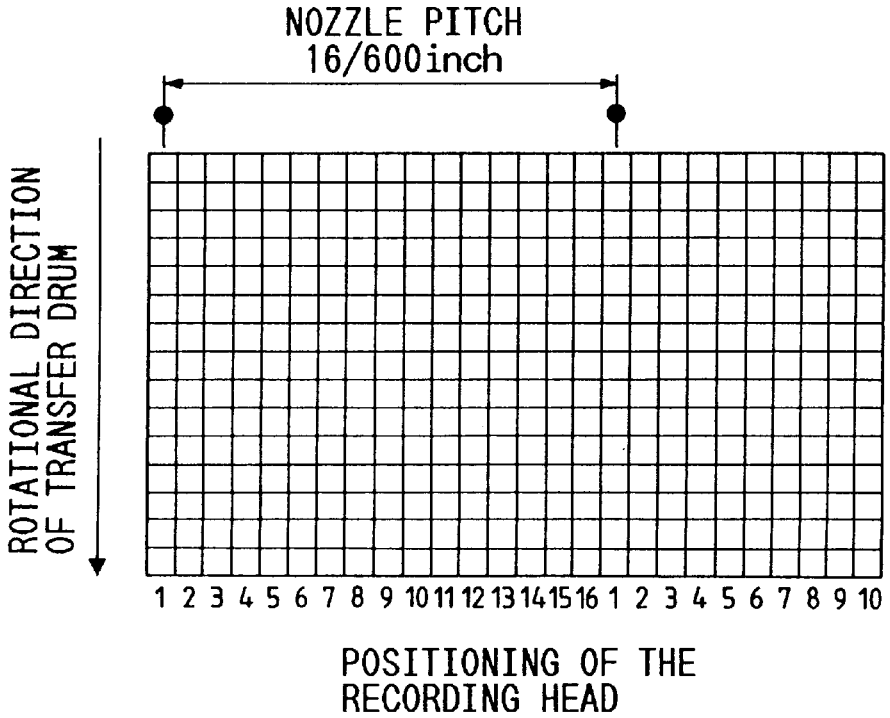
FIG. 13 is a diagram showing a method of dividing the recording area of the ink jet recording apparatus of the sixth embodiment of the invention.

The image writing step will be described with reference to FIGS. 12 and 13. The recording area on the transfer drum 1 is divided into 16 regions for each nozzle of the recording head 2. The recording head 2 is positioned by the recording head moving device 120 so as to correspond to a block which is to be firstly recorded. While the transfer drum 1 conducts one turn in the direction of an arrow A, the nozzles (in FIG. 12, two nozzles 200 and 201 are representatively illustrated) then eject ink to form an ink image. In FIG. 12, the ink image is shown by dot strings 202 and 203. After the writing step for one turn has been conducted on the transfer drum 1, the recording head 2 is moved to the next writing block in the direction of an arrow D or E in the unit of 1/600 inches. The transfer drum 1 begins the second turn so that dot strings are formed on the transfer drum 1 in the same manner as the first turn. Since the nozzle pitch h is 16/600 inches, the transfer drum 1 makes 16 turns in the same manner to form an image of one page on the transfer drum 1.

Figure 14:
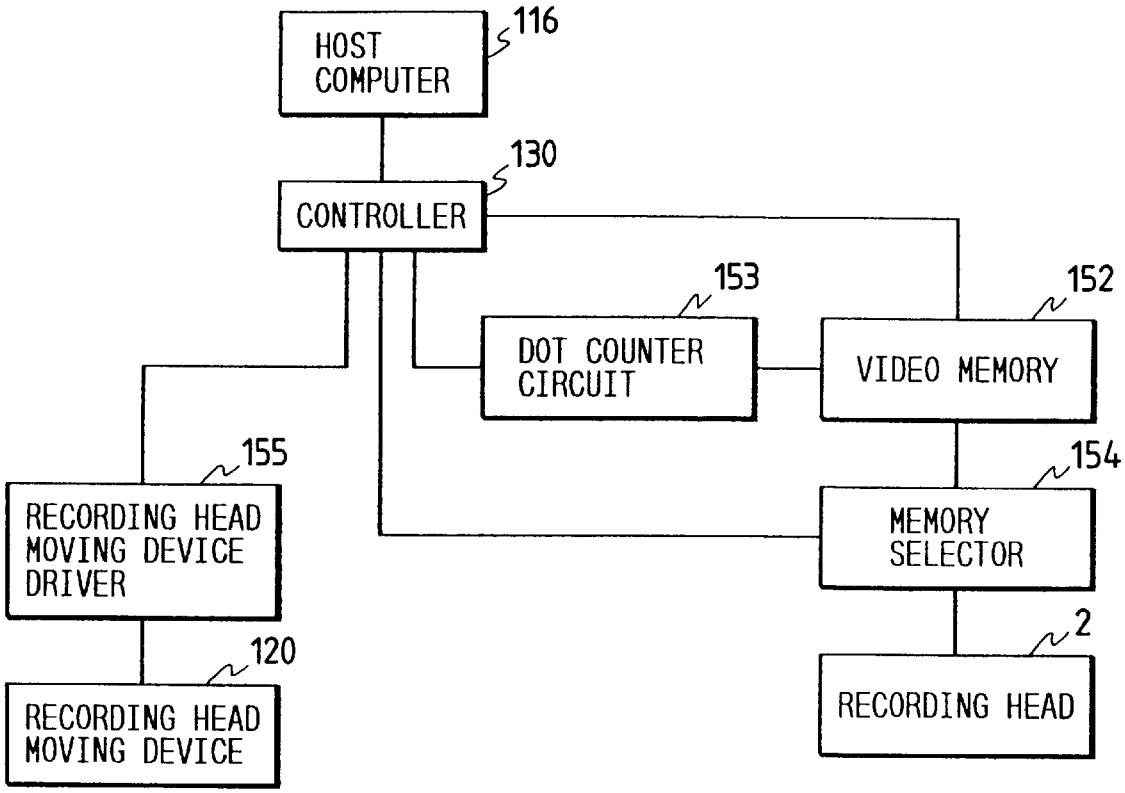
FIG. 14 is a block diagram of the main portion of the ink jet recording apparatus of the sixth embodiment of the invention.

The method of deciding the sequence of the writing blocks will be described with reference to FIG. 14. First, printing instructions and printing data are transmitted from a host computer 116. Then a controller 130 develops the printing data in a video memory 152 in accordance with the printing instructions. The video memory 152 consists of 16 blocks in total. Each of the blocks has a capacity of about 2.5 megabits obtained by multiplying the total nozzle number of 512 by 4,864 dots which can be printed by one nozzle during one turn of the transfer drum 1. When data of one page have been developed, a dot counter 153 counts the number of printing dots of each of the writing blocks in the video memory 152, and informs the controller 130 of the counted values. The controller 130 decides the sequence of printing the blocks in order of decreasing counted value, and transfers information indicative of the sequence of the printing blocks to a memory selector 154. In deciding the sequence, however, restriction is set so that adjacent blocks are not successively subjected to the printing step. The memory selector 154 reads out printing data from the video memory 152 on the basis of the sequence information, and transfers the data to the recording head 2. In accordance with the sequence of the printing blocks, the controller 130 causes a recording head moving device driver 155 to drive the recording head moving device 120 so as to conduct the positioning of the recording head. In the embodiment, the sequence changing means is constituted by the controller 130.

Next, the transfer step will be described. After an image of one page has been formed on the transfer drum 1, the pressure roller 3 is pressed against the transfer drum 1. Timing is provided so that the recording start position corresponds to the leading portion of the recording sheet, and the recording sheet 5 is transported to the area where pressure roller 3 contacts transfer drum by sheet transporting means 141 (see FIG. 11), thereby starting the transfer step. When the end portion of the recording sheet 5 has been subjected to the transfer step and passes through the area of contact between pressure roller 3 and transfer drum 1, the pressure roller 3 is separated from the transfer drum 1 so that the recording sheet 5 is discharged.

As a result of the above steps, the recording of one page is completed.

Figure 15:
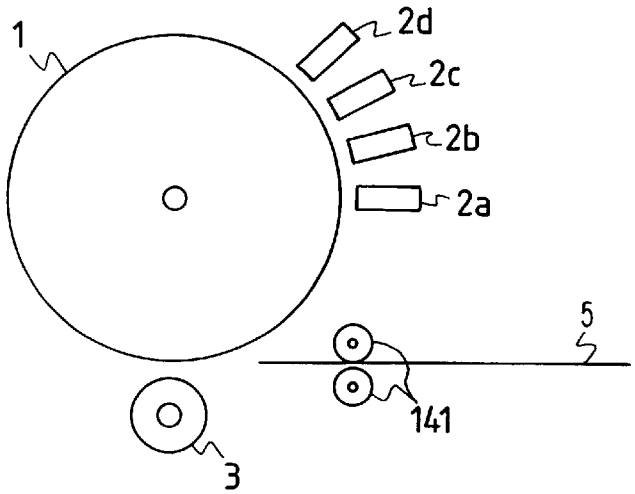
FIG. 15 is a side view of an ink jet recording apparatus of a seventh embodiment of the invention.

FIG. 15 is a side view of a color ink jet printer which is a seventh embodiment of the invention. Recording heads 2*a* to 2*d* and a transfer roller 3 are arranged around a transfer drum 1. The recording heads 2*a* to 2*d* can be independently moved by head moving devices 120*a* to 120*d* structured in the same manner as the moving device of the sixth embodiment, respectively. The recording heads perform the color printing. Namely, the recording head 2*a* ejects ink of black, the recording head 2*b* ink of cyan, the recording head 2*c* ink of magenta, and the recording head 2*d* ink of yellow. The mechanisms for transporting a recording sheet 5 and conducting a switching operation of the pressure roller 3 are structured in the same manner as those of the sixth embodiment.

Figure 16:
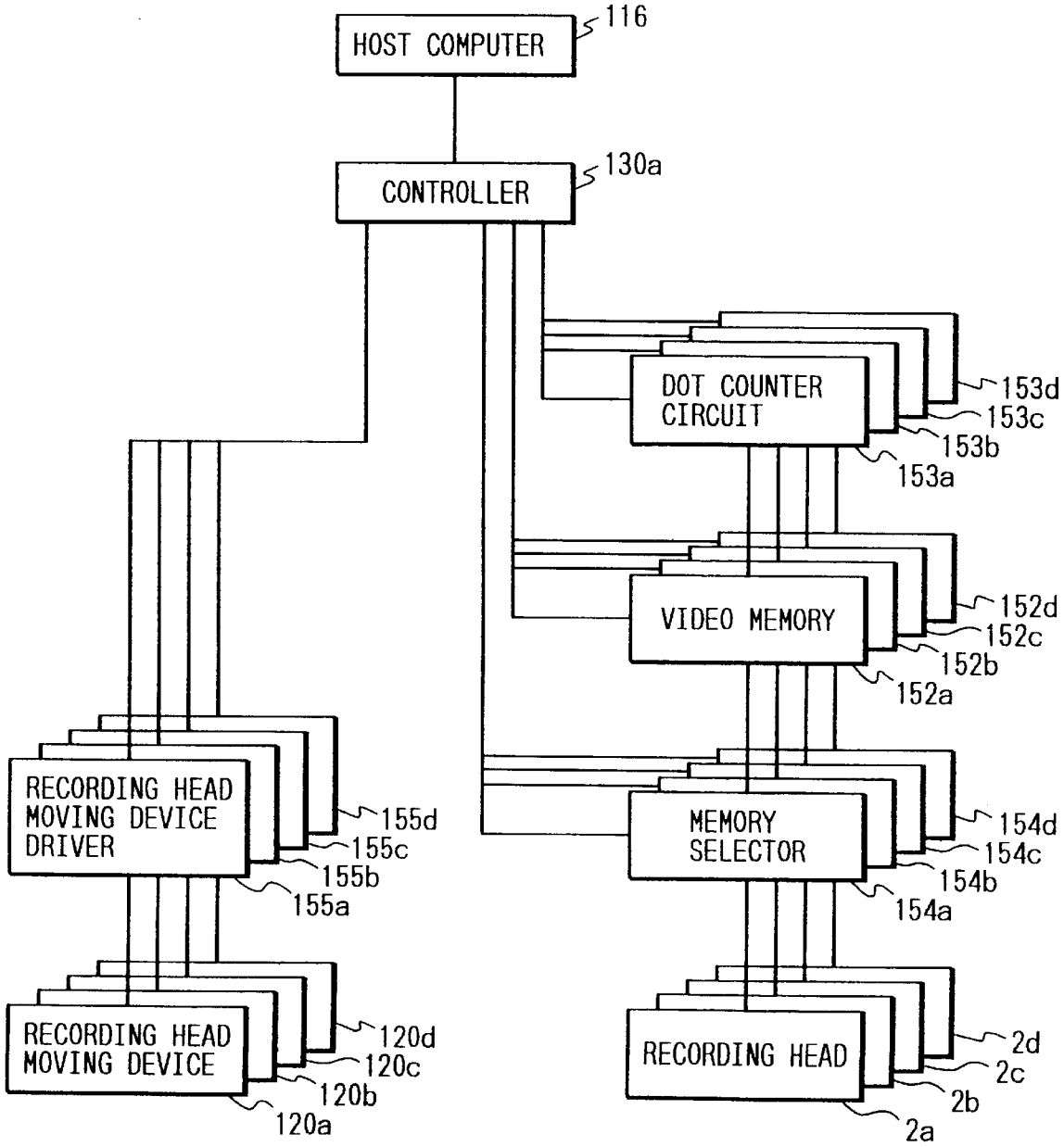
FIG. 16 is a block diagram of the main portion of the ink jet recording apparatus of the seventh embodiment of the invention.

The operation of the printer will be described with reference to FIG. 16. A controller 130*a* receives printing instructions and printing data from a host computer 116. The controller 130*a* develops the printing data in video memories 152*a* to 152*d* in accordance with the printing instructions.

The video memories are independently provided for respective colors. When data of one page have been developed, dot counters 153*a* to 153*d* count the number of printing dots of each of the printing blocks in the video memories 152*a* to 152*d*, and inform the controller 130*a* of the counted values. The controller 130*a* decides the printing sequence of the video memories 152*a* to 152*d* in order of decreasing number of printed dots. In deciding the sequence, restriction is set so that adjacent blocks are not successively subjected to the printing step for each color, and that the same block is not printed plural times in the same rotation of the transfer drum 1. The controller 51 transfers information indicative of the decided sequence, to memory selectors 154*a* to 154*d*. The memory selectors 154*a* to 154*d* read out printing data from the video memories 152*a* to 152*d* in the decided sequence in synchronization with the rotation of the transfer drum 1, and transfer the data to the respective recording heads 2*a* to 2*d*. The controller 130 controls the recording heads 2*a*to 2*d* so as to cause them to move to the respective blocks to be printed, by sending instructions to recording head moving device drivers 155*a* to 155*d* to drive the recording head moving devices 120*a* to 120*d*.

According to the embodiment, the conditions under which an ink film is formed on a transfer medium are corrected by changing the sequence of writing blocks of printing data in accordance with the number of printing dots, thereby allowing recording with a high printing quality. Since adjacent blocks are not successively subjected to the printing step, ink coagulation can be prevented. In a color printing, ink mixing on the transfer medium is not conducted in the same turn of the transfer medium, thereby preventing enlargement of the dot diameter due to ink mixing before formation of the film and thus allowing recording having a high printing quality.

In the above, embodiments having an ink jet recording head which uses piezoelectric elements have been described. The invention is not restricted to this, and a recording head using heating elements may be employed. A belt type transfer medium may be used in place of a drum transfer medium.

What is claimed is:

1. The ink jet recording method in which an ink image is written on a transfer medium by a recording head and transferred to a recording medium, said recording head being opposed to said transfer medium and separated therefrom by a gap, and a main scanning and a subscanning are conducted on said transfer medium, wherein an ink image medium writing step is conducted by selectively ejecting ink drops from said recording head, said ink image writing step comprising:

a) a first scanning step in which ink dot strings are formed in a main scanning direction so as not to adjoin each other in at least a subscanning direction;

b) a second scanning step in which said recording head is moved in the subscanning direction and ink drops are impacted to positions which are not adjacent to an ink dot string which is lastly formed on said transfer medium in an immediately preceding scanning step; and c) a step in which said second scanning step is repeated until a desired ink image is written;

wherein ink dot strings which are adjacent to each other on said transfer medium in the subscanning direction are formed by ink drops ejected from different nozzles of said recording head and wherein steps (a) to (c) are performed without setting nozzles in a printing area to an unused state.

2. An ink jet recording method in which an ink image is written on a transfer medium by a recording head and transferred to a recording medium, said recording head being opposed to said transfer medium and separated therefrom by a gap, and a main scanning and a subscanning are conducted on said transfer medium, wherein an ink image writing step is conducted by using a recording head having a plurality of nozzles which are separated by a gap corresponding to P pixels in a subscanning direction, said ink image writing step comprising:

a) a first scanning step in which, for each main scanning, ink dot strings are written by moving said recording head in one subscanning direction by a distance corresponding to Z pixels, wherein Z and P are predetermined natural numbers which satisfy a relationship of $2 \leqq Z \leqq P-2$, and a ratio Z/P is an irreducible fraction; and b) a step in which said first scanning step is repeated until a desired ink image is written;

wherein ink dot strings are not written directly adjacent one another in immediately succeeding scanning steps.

3. The ink jet recording method according to claim 2, wherein, in said ink image writing step, the subscanning of said recording head is commenced when at least a Zth nozzle in the subscanning direction of said recording head is made coincident with an edge of a printing area.

4. An ink jet recording apparatus in which an ink image is formed on a surface of a transfer medium, and the ink image is transferred from the transfer medium to a recording medium, said apparatus comprising:

a recording head having a plurality of ink ejecting nozzles which are arranged in a line;

a transfer medium which is opposed to said recording head and separated therefrom by a gap and rotatably supported, and on which the ink image is formed by said recording head, said transfer medium being turned repeatedly;

moving means for moving said recording head by a predetermined distance in a subscanning direction for every turn of said transfer medium; and transfer means for transferring the ink image on said transfer medium to said recording medium, wherein the ink image is formed by forming an ink dot string on said transfer medium with each of said nozzles in a printing area during each successive turn of said transfer medium, wherein said ink dot string is impacted to a position on the transfer medium which is not adjacent to a previously formed ink dot string which is lastly formed on said transfer medium, and wherein, during formation of the ink image, said moving means moves said recording head in only one subscanning direction.

5. The ink jet recording apparatus according to claim 4, wherein said predetermined distance is selected such that ink dot strings which are adjacent to each other on said transfer medium in the subscanning direction are formed by ink drops ejected from different nozzles of said recording head.

6. The ink jet recording apparatus according to claim 5, wherein, during formation of the ink image, said predetermined distance is identical for each turn of said transfer medium.

7. The ink jet recording apparatus according to claim 6, wherein said predetermined distance is three pixels.

8. The ink jet recording apparatus according to claim 4, wherein said apparatus further comprises heating means for heating the ink image formed on said transfer medium.

9. The ink jet recording apparatus according to claim 5, wherein said apparatus further comprises heating means for heating the ink image formed on said transfer medium.

10. The ink jet recording apparatus according to claim 6, wherein said apparatus further comprises heating means for heating the ink image formed on said transfer medium.

11. The ink jet recording apparatus according to claim 7, wherein said apparatus further comprises heating means for heating the ink image formed on said transfer medium.

* * * * *